United States Patent [19]

Lloyd et al.

[11] Patent Number: 4,947,592

[45] Date of Patent: Aug. 14, 1990

[54] PARTICLE BLAST CLEANING APPARATUS

[75] Inventors: Daniel L. Lloyd, Mason; Newell D. Crane, Cincinnati; David E. Moore, Milford, all of Ohio

[73] Assignee: Cold Jet, Inc., Cincinnati, Ohio

[21] Appl. No.: 227,090

[22] Filed: Aug. 1, 1988

[51] Int. Cl.[5] ..... B24C 7/00

[52] U.S. Cl. ..... 51/436; 51/322; 134/7

[58] Field of Search ..... 51/320, 322, 410, 436, 51/437, 439; 134/7; 222/345, 346, 368

[56] References Cited

U.S. PATENT DOCUMENTS

| | | | |
|---|---|---|---|
| 2,421,753 | 6/1947 | Joyce | 62/104 |
| 3,089,775 | 5/1963 | Lindall | 99/107 |
| 3,101,853 | 8/1963 | Long et al. | 222/368 X |
| 3,110,983 | 11/1963 | Moore | 51/9 |
| 3,130,879 | 4/1964 | Messing | 222/368 |
| 3,137,101 | 6/1964 | Leliaert | 51/13 |
| 3,151,784 | 10/1964 | Tailor | 222/368 |
| 3,160,993 | 12/1964 | McCormick | 51/9 |
| 3,219,393 | 11/1965 | Starrett | 302/49 |
| 3,245,590 | 4/1966 | Hawkins | 222/368 |
| 3,324,605 | 6/1967 | Lester | 51/314 |
| 3,422,580 | 1/1969 | Balz | 51/314 |
| 3,485,074 | 12/1969 | Compton | 72/53 |
| 3,556,355 | 1/1971 | Ruiz | 222/368 |
| 3,633,797 | 1/1972 | Graff | 222/368 X |
| 3,676,963 | 7/1972 | Rice et al. | 51/320 |
| 3,702,519 | 11/1972 | Rice et al. | 51/310 |
| 3,768,210 | 10/1973 | Johnson | 51/12 |
| 4,038,786 | 8/1977 | Fong | 51/320 |
| 4,180,188 | 12/1979 | Aonuma | 222/368 |
| 4,372,338 | 2/1983 | Efferson | 222/368 X |
| 4,389,820 | 6/1983 | Fong | 51/410 |
| 4,441,434 | 4/1984 | Howard | 222/368 X |
| 4,463,736 | 8/1984 | Hayward, Jr. | 222/368 X |
| 4,536,121 | 8/1985 | Stewart | 414/219 |
| 4,617,064 | 10/1986 | Moore | 134/7 |
| 4,707,951 | 11/1987 | Gibot et al. | 51/410 |
| 4,727,687 | 3/1988 | Moore | 51/410 |
| 4,744,181 | 5/1988 | Moore | 51/436 |

*Primary Examiner*—Robert P. Olszewski
*Attorney, Agent, or Firm*—Frost & Jacobs

[57] ABSTRACT

An improved particle blast cleaning apparatus and process featuring sublimable pellets as the particulate media is described as having a source of sublimable pellets, a housing defining an internal cavity having spaced pellet receiving and discharge stations, and a radial transport rotor for transporting the pellets from the receiving station to the discharge station. The radial transport rotor further includes a plurality of transport cavities each being formed in the circumferential surface of the radial transport rotor to receive the pellets for radial transport between the receiving and discharge station. The receiving station is in communication with the source of sublimable pellets, and has a mechanically assisted flow of the pellets to the transport cavities. Also included is a discharge nozzle and a high pressure transport gas source for conveying the pellets from the discharge station to the discharge nozzle.

44 Claims, 6 Drawing Sheets

PARTICLE BLAST CLEANING APPARATUS

TECHNICAL FIELD

The present invention relates generally to a particle blast cleaning apparatus and method, and is particularly directed to an improved apparatus and method for transporting sublimable particulate media from a receiving station to a discharge station within such a particle blast cleaning apparatus.

BACKGROUND ART

Particle blast cleaning apparatus are well known in the industry. While sandblasting equipment is widely used for many applications, it has been found that the utilization of particles which naturally sublimate can advantageously be utilized as a particulate media of such equipment to minimize adverse environmental results and cleanup required following the cleaning activity.

Earlier particle blast cleaning apparatus utilizing subliminal particles have included a rotary transport and more recently a lateral slide bar transport. An example of the rotary transport may be found in U.S. Pat. No. 4,617,064, which issued to the present inventor Moore on Oct. 14, 1986. It discloses a particle blast cleaning apparatus utilizing carbon dioxide pellets in a high pressure carrier gas. The particular particle blast apparatus described in the Moore '064 patent includes a body which houses a rotary pellet transport mechanism having transport bores used to convey the carbon dioxide pellets from a gravity feed storage hopper to the high pressure carrier gas stream for transportation of the pellets to a discharge nozzle.

While the apparatus and method described in the Moore '064 patent can be utilized to accomplish particle blast cleaning, there are some very important practical problems. One significant problem associated with this apparatus is the agglomeration of the pellets when exposed to moisture. This moisture can be introduced into the system from the high pressure carrier gas stream through the discharging station. For this reason it is important to effectively seal out the moisture contained in the high pressure gas stream. In order to ensure that the high pressure gas does not leak into the rotary transport apparatus, a rather complex system of variable pressure gas seals is necessary.

In the Moore '064 reference, the rotary apparatus is fitted with a corresponding set of circular face seals, and means to establish a force on such seals which is proportional in magnitude to the pressure of the transport gas. In order to achieve and maintain this critical sealing function, the circular seals must remain substantially flat in order to remain in intimate, continuous contact with the surfaces to be sealed. In addition to the manufacture of the rotor, a significant amount of machining is required to the housing that the rotary transport is disposed in. These factors contribute to a relatively high fabrication cost of the rotary transport unit.

As a result of the force required to be exerted on the seals, the sealing surfaces must withstand a relatively great amount of friction, with such friction being applied at varying rubbing velocities across the diameter of such circular seals. The rubbing velocity and friction differentials tend to wear the seals at correspondingly different rates, creating a relatively difficult seal maintenance problem. Additionally, it has been found that the seal surface becomes subjected to erosion in critical sealing areas adjacent the receiving station due to occasional shearing of the particulate media at the cavity/-receiving station interface.

These seal maintenance problems led to the icing of the rotor surface due to the low temperature and slight residual moisture of the air supply which further degrades the seal, thereby allowing additional moist air to leak into the system. Empirically, it has been observed that the system under the Moore '064 patent cannot operate at discharge air pressures above approximately 175 psig without causing significant leakage of moist air into the apparatus. In order to provide delivery of the Particulate media at a sufficient velocity from the nozzle, it is necessary that the apparatus be capable of handling higher discharge air pressures.

It was also found that the apparatus design results in a slight time delay between successive discharge of pellets from the transport means. This causes a non-uniform or pulsating discharge of the particulate media from the apparatus. Additional rotary mechanisms which could be added using the Moore '064 design present a relatively complex and expensive modification problem. Maintenance problems would, of course, be correspondingly multiplied with the addition of more transport means.

Present inventors Moore and Crane have been issued U.S. Pat. No. 4,744,181 for a Particle-Blast Cleaning Apparatus And Method. The Moore '181 Patent discloses a lateral transport apparatus, which offers certain advantages over the rotary transport method. However, several drawbacks remain with the apparatus disclosed therein. In the lateral transport apparatus a plurality of sliding bars, each having a transport cavity which is alternatively alignable with a receiving station and a discharge station, is disposed within channels located in a housing. As each individual bar reciprocates laterally, the corresponding transport cavity is brought alternatively into alignment with the receiving station, at which position pellets are gravity fed into the transport cavity, or with the discharge station, at which position the pellets are discharged by the high pressure carrier gas stream for transportation of the pellets to the discharge nozzle. The relative positioning of each transport cavity is synchronized such that the time delay between successive discharges of pellets from the nozzle is minimized.

With the lateral transport apparatus, it also is necessary to maintain a seal between the upper and lower surfaces of the slide bar to prevent moist air of the high pressure carrier gas stream from leaking into the transport apparatus. Here again, face seals are used to seal between the sliding bar and the housing. It has been discovered that close tolerances are required to maintain the necessary flatness of the mating parts. This problem of sealing is multiplied by the use of the plurality of slide bars disclosed in the application.

The increased number of moving parts, combined with the close tolerances required, results in a design that is both expensive to manufacture and to maintain. Also, by increasing the number of sliding parts which are sealed, the frictional losses of the unit are correspondingly increased. Empirically it has been determined that this system will not operate at discharge pressures above approximately 125 psig, because it requires additional drive power due to excess seal friction. This further limits the ability to obtain the required airflow velocity necessary to maximize the effectiveness of the cleaning apparatus.

Both the Moore '064 and Moore et al '181 patents use only the action of gravity for transporting the Pellets from the storage hooper to the transport cavities. It has been observed that the gravity feed by itself produces less than optimum flow to the transport cavity, resulting in only a partial fill of the cavity. In order to obtain a complete fill of the cavity using only gravity feed, it is necessary to increase the dwell time of the transport cavity at the receiving station. The result of increasing the dwell time is a decrease in the delivery frequency of the particulate media to the discharge station, thereby decreasing the delivery of the media to the nozzle and subsequently to the work piece. Thus the operator is faced with the choice between one frequency of delivery of a quantity of pellets which only partial fills the transport cavity, or a lower frequency of delivery of a greater quantity of pellets which completely fills the transport cavity. While gravity flow of the pellets to the transport cavities can be used to deliver pellets to the transport gas flow and subsequently to the work piece, it results in the delivery of less than the optimum quantity of pellets to the work piece.

Despite the prior work done in this area, there remain problems of improving the reliability and cost of achieving and maintaining a proper seal between the particulate media transporting apparatus and the high pressure conveying gas required to discharge such particulate media. Additionally, there remained problems with achieving a relatively uniform delivery of sublimable particulate media in an economical and relatively simple manner. Consequently, prior art structures and processes delivered a relatively inefficient system with rather high maintenance costs.

DISCLOSURE OF THE INVENTION

It is an object of this invention to obviate the above-described problems.

It is another object to provide an improved particle blast cleaning apparatus featuring sublimable pellets as the particulate media and utilizing an improved pellet feeder means and process comprising a radial transport.

It is yet another object of the present invention to achieve an improved particle blast cleaning apparatus capable of economically providing a relatively uniform flow of sublimable pellets in a stream of pressurized transport gas to a discharge nozzle.

It is also an object of the present invention to provide an improved apparatus and method for radially transporting sublimable pellets in a particulate blast cleaning apparatus, with such apparatus featuring effective and reliable seals therewithin which can be easily maintained.

It is another object of the present invention to provide an improved particle blast cleaning apparatus with a high pressure carrier gas stream.

It is a further object of the present invention to provide an improved particle blast cleaning apparatus which can use high pressure carrier gas having a higher moisture content.

Finally, it is an object of this invention to provide an improved particle blast cleaning apparatus which maximizes the flow of sublimable pellets into the high pressure carrier gas stream.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, there is provided an improved particle blast cleaning apparatus featuring sublimable pellets as the particulate media, with such apparatus including a source of sublimable pellets, a housing means having pellet receiving and discharge stations, and a radial pellet feeder means for transporting the pellets from the receiving station to the discharge station. The feeder means includes a rotor having one or more transport cavities disposed in the circumferential surface of the rotor to receive the pellets for radial transport between such stations. The apparatus further includes a means for providing mechanically assisted flow of the pellets to the transport cavities at the receiving station, a discharge nozzle, and a means for supplying a pressurized transport gas adjacent the discharge station for conveying the pellets leaving the discharge station to the discharge nozzle.

Still other objects of the present invention will become apparent to those skilled in this art from the following description wherein there is shown and described a preferred embodiment of this invention, simply by way of illustration, of one of the best modes contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description serve to explain the principles of the invention. In the drawings.

Reference will now be made in detail to the present preferred embodiment of the invention, an example of which is illustrated in the accompanying drawings.

DETAILED DESCRIPTION OF THE PREFERRED EMBODIMENT

Figure 1:
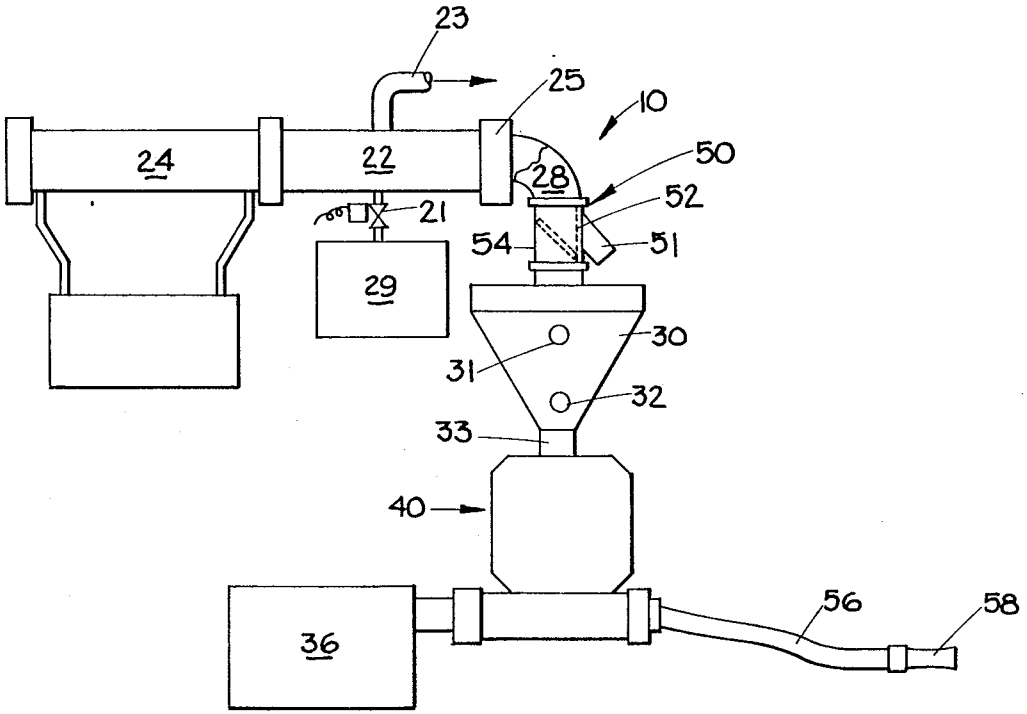
FIG. 1 is an elevational view in schematic form illustrating a preferred embodiment of the particle blast cleaning apparatus of the present invention.

Referring now to the drawings in detail, wherein like numerals indicate the same elements throughout the views, an improved particle-blast cleaning apparatus 10 of the present invention is shown in FIG. 1. In particular, cleaning system 10 is illustrated in the form it would most preferably take for use wherein the particulate media is formed from liquid carbon dioxide. Such liquid carbon dioxide is stored in a storage chamber 29 at relatively high pressure (e.g. about 300 psig) prior to injection via inlet 21 into a pellet extrusion cylinder 22 at approximately atmospheric pressure where such liquid carbon dioxide passes into the solid stage.

Liquid carbon dioxide ($CO_2$) is maintained at about 300 psi and about 0° F. (−18° C.) in storage chamber 29 prior to being injected via the inlet 21 into extrusion cylinder 22 which is maintained at approximately atmospheric pressure. Due to the sudden drop in pressure, a portion of the liquid $CO_2$ crystallizes from its liquid phase to a solid or "snow" phase. The snowflakes are retained within extrusion cylinder 22 by screens (not shown) which cover the outlet 23 through which waste gas is discharged. Upon collection of a predetermined amount of such snow within cylinder 22, a hydraulic ram 24 drives a piston forward within extrusion cylinder 22 to compress the snowflakes to a solid block, which in turn is extruded through a die in pelletizer 25.

The resulting solid $CO_2$ pellets pass through pellet conduit 28 to diverter means 50. During the initial start-up of the subject particle blast cleaning apparatus, extrusion cylinder 22 and pelletizer 25 must chill down to proper operating temperature (i.e. about −100° F. or −74° C.). During this chill-down time, imperfect pellets often result which are preferably disposed of as opposed to being run through the entire apparatus. It is for this reason that it is preferred that particle blast apparatus 10 include means 50 for diverting these imperfect pellets immediately outside of the apparatus. In this regard, diverter means 50 is shown as including a diverter valve 52 which can be hingedly moved between open and closed positions (both positions being shown by the broken lines of FIG. 1 — the closed position depicted by the substantially vertical broken lines).

Because it is preferred to maintain portions of the pellet hopper 30 at pressures slightly above atmospheric, it is preferred that diverting valve 52 include sealing means (not shown) for providing an airtight seal in its closed positions. It has been found that such sealing means can adequately be provided by a silicon rubber flexible sealing ring attached about the periphery of diverter valve 52 to provide an interference fit with waste chute 51 and, alternatively, the inner surfaces of diverter conduit 54 which connects pellet conduit 28 and the upper portions of hopper 30. Once extrusion cylinder 22, pelletizer 25 and pellet conduit 28 are sufficiently chilled down, the diverter valve 52 can be closed so that the pellets flow directly into hopper 30 where they are accumulated for subsequent discharge.

Figure 2:
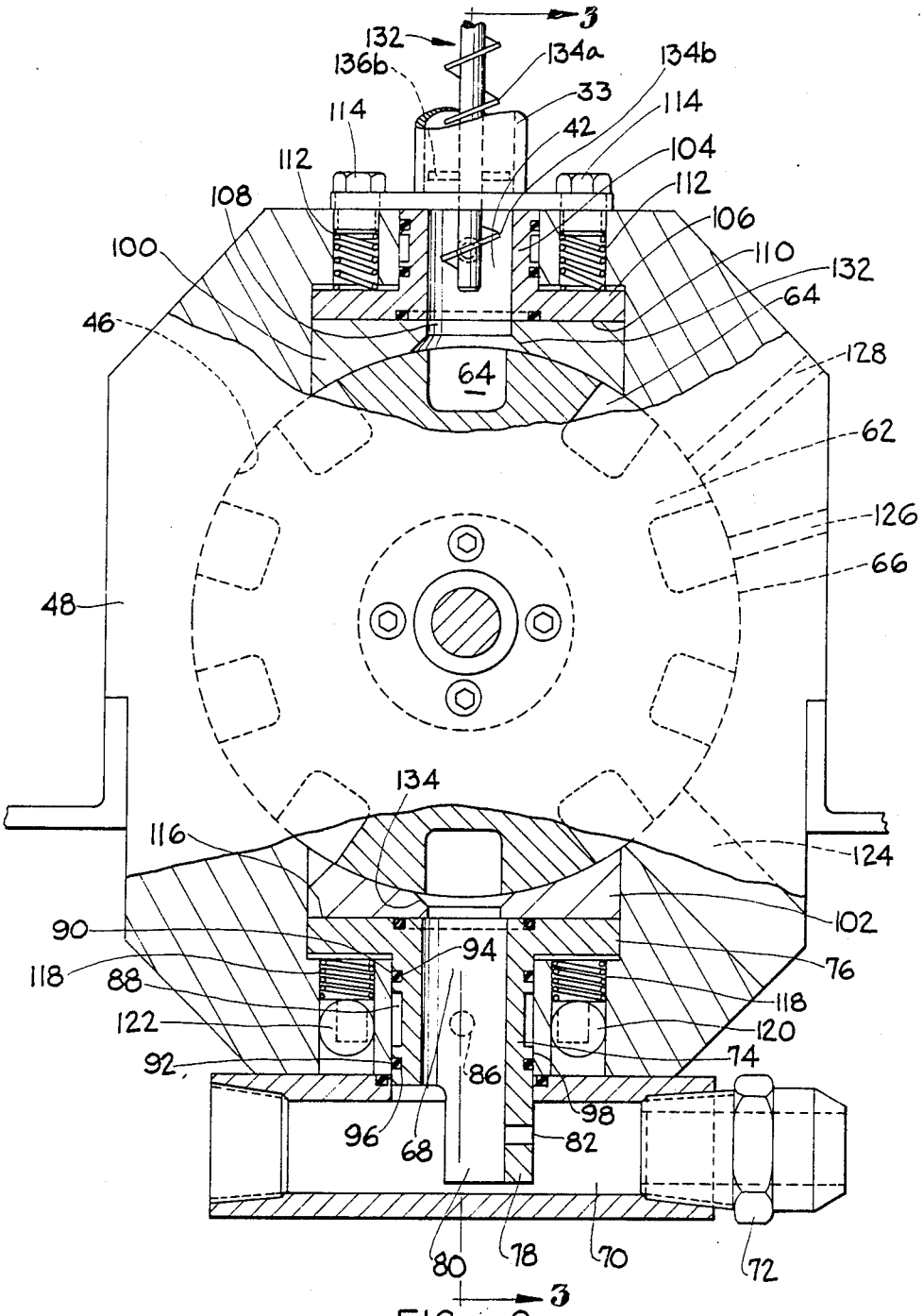
FIG. 2 is a partial cross sectional view of the radial pellet feeder means of FIG. 1.

Hopper 30 serves to provide surge capacity for apparatus 10 during use, and preferably includes high and low level sensors (e.g. sensors 31 and 32, respectively) to indicate the relative level of stored pellets therewithin. A separate $CO_2$ gas line can be advantageously utilized to provide a slight positive pressure within hopper 30. This slightly positive pressure of $CO_2$ gas within hopper 30 can in turn be utilized to preclude the influx of ambient air into hopper 30 during pellet transport operations. Particularly, the $CO_2$ gas within hopper 30, being under slight pressure (e.g. approximately 1 psig) will flow outwardly when pellets are discharged from hopper 30 at receiving station 42, as shown in FIG. 2, thereby preventing the inflow of ambient air which may contain moisture. It is critical that moisture not enter the system at the receiving station of the feeder where it could enter the hopper, as moisture would quickly freeze at the extremely low temperatures involved herein, which could result in possible freeze-ups of the system or less efficient flow of particles therewithin. From hopper 30, pellets are moved by helical worm screw 132 through feed chute 33 to pellet receiving station 42. At pellet receiving station 42, pellets flow into pellet feeder means 40, due to the action of helical worm screw 132, for radial transport to the pressurized discharge system of the apparatus.

Figure 1A:
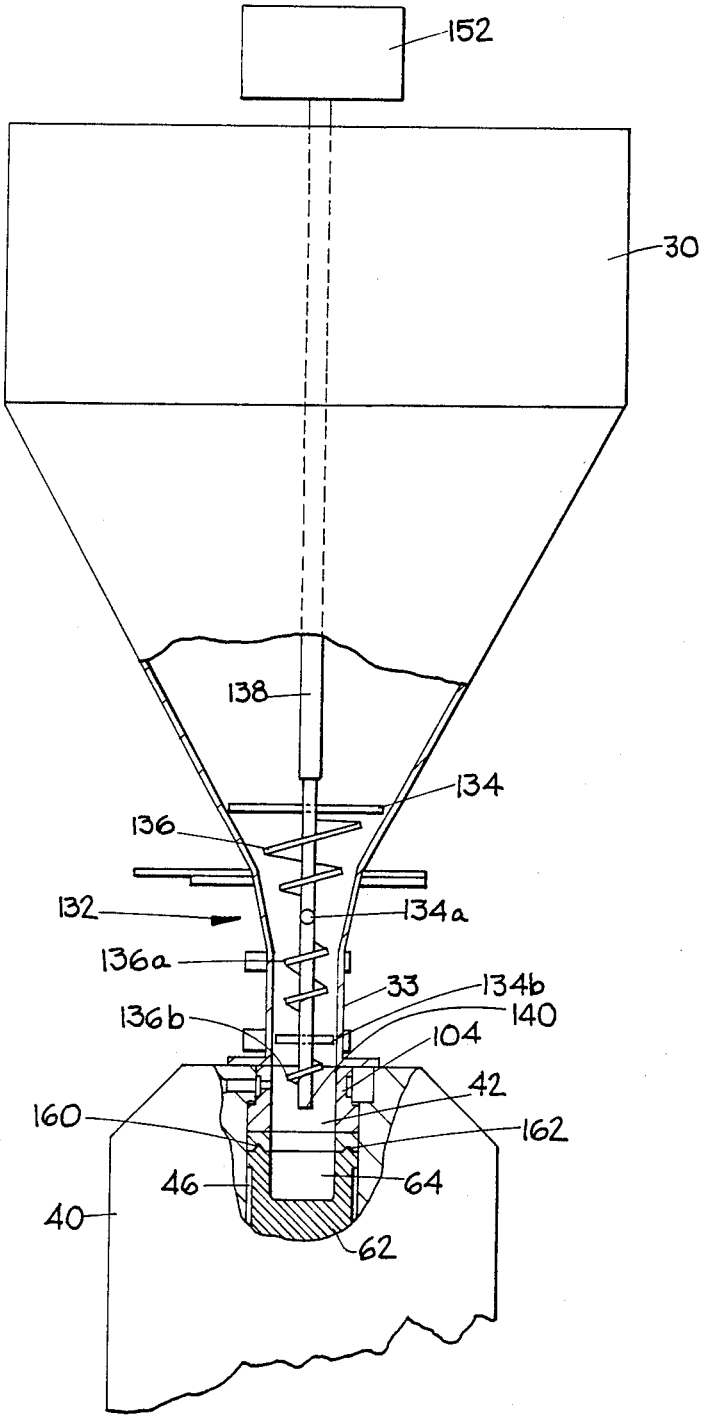
FIG. 1A is a partial cross sectional view of the hopper and radial pellet feeder means of FIG. 1 showing the helical worm screw.

FIG. 1A shows a partial cross sectional view of the hopper 30 and helical worm screw 132. Pellets are deposited into hopper 30, preferably to a level well above agitating rod 134, thereby submerging the helical worm screw 132. Helical worm screw 132 has a plurality of downwardly inclined helical surfaces 136, **136*a*, 136*b*, protruding from the shank 138, separated by agitating rods 134*a*, 134*b*, spiraling down through feed chute 33 and terminating at end 140 of shank 138. End 140 is disposed in receiving station 42 of pellet feeder means 40. The lower portion of hopper 30 is inclined towards the center line of shank 138 thereby funneling the pellets into proximity with the helical worm screw 132**.

The diameter of inclined helical surfaces 136, **136*a*, 136*b* is significantly smaller than the corresponding openings in the hopper 30, feed chute 33 and receiving station 42. As shown in FIG. 1A, the diameter of the helical worm screw 132 is approximately one half of the diameter of the corresponding internal surfaces. Helical worm screw 132 rotates in a direction such that pellets proximate to it are advanced along the inclined surfaces 136, 136*a*, 136*b* and are fed into receiving station 42. Agitating rods 134, 134*a*, 134*b* rotate with shank 138 to agitate the pellets, thereby assisting the uniform delivery of the pellets through feed chute 33. The rotation of helical worm screw 132 causes the pellets to be mechanically advanced into receiving station 42 and into transport cavity 64, when cavity 64 is aligned with receiving station 42. The rotation of driveshaft 138 may be synchronized with the rotation of radial transport rotor 62, but also works equally well without being so synchronized. The shapes and sizes of the internal surfaces of the hopper 30, feed chute 33, and receiving station 42, in conjunction with the shape and size of helical worm screw 132 allow any backup surge or excess flow of pellets created when transport cavity 64 is not radially aligned with receiving station 42 to be absorbed by the clearance around the helical worm screw 132 whereby pellets may flow in the reverse direction along the walls of the internal surfaces. The rotational speed of shank 138 is selected with consideration of the rotation of the radial transport rotor 62 to ensure that the desired fill of cavity 64 is accomplished. Shank 138 may be driven by a separate motor 152 or by the same rotational source as drive rotor 62**.

Figure 3:
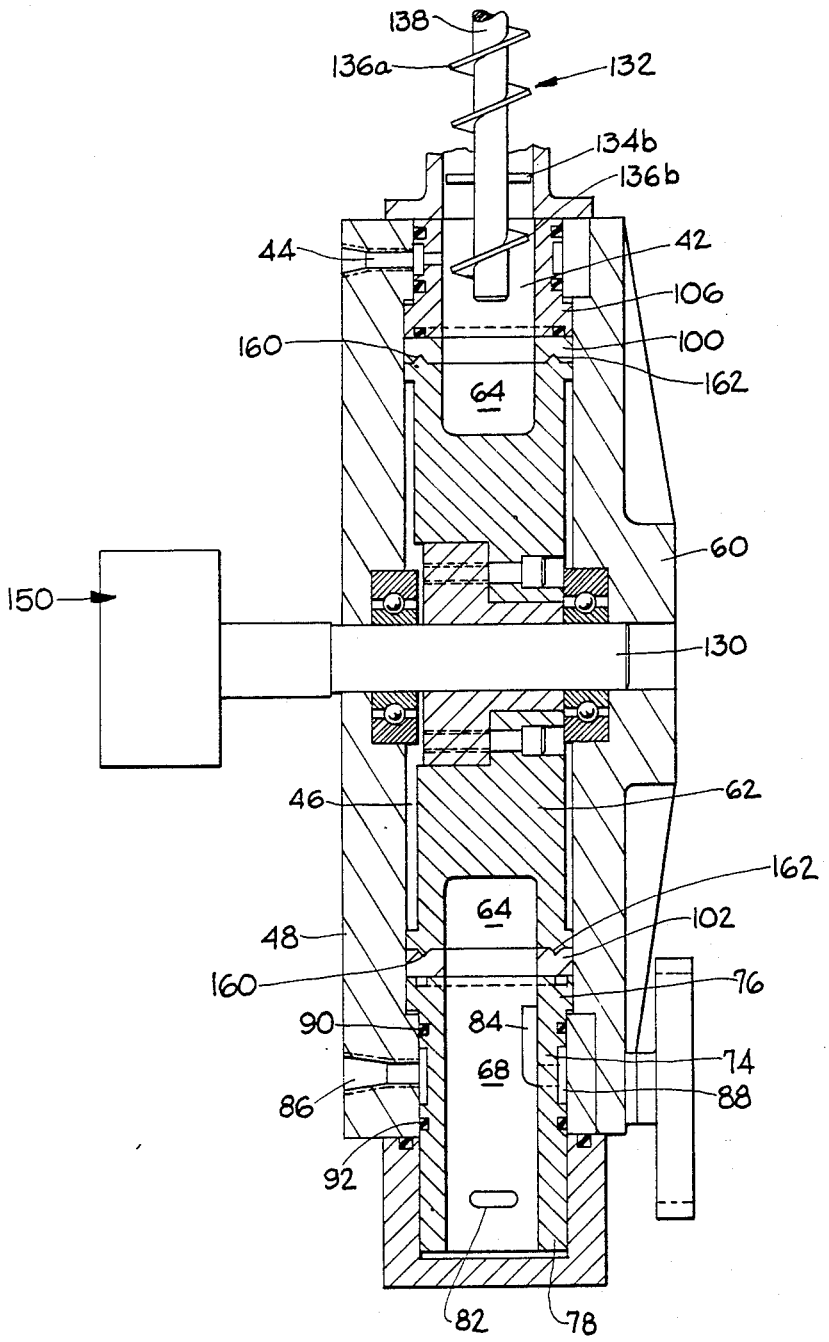
FIG. 3 is a side sectional view of the radial feeder, taken along section line 3—3 of FIG. 2.

FIG. 2 shows a partial cross-sectional view of the radial pellet feeder means 40. Pellets are fed through feeder chute 33 into receiving station 42 by helical worm screw 132. As mentioned above, it is important to maintain a slight pressure within the hopper and pellet feeder apparatus to prevent the entrance of any moisture containing air which could cause individual pellets to freeze together and possibly block or substantially impair the flow of pellets through the system. It is preferred, however, to maintain such pressure at a relatively low value (e.g. 1 psig) because it has been found that pressures above 10 psig tend to diminish the efficiency of the pellet extrusion and forming process described above. $CO_2$ gas flows into the receiving station 42 along with the pellets and is vented out of the receiving station 42 through vent 44. Vent 44 may communicate directly with the ambient environment or may discharge the $CO_2$ gas into other areas of the radial pellet feeder means 40. Receiving station 42 communicates with rotor cavity 46. Rotor cavity 46 is formed by housing 48 and cover 60, shown in FIG. 3. Cover 60 is secured to housing 48 by bolts (not shown). Rotor 62 is rotatably mounted in rotor cavity 46, and is provided with a plurality of transport cavities 64 in the circumferential surface 66 thereof. Rotor 62 is connected to shaft 130, which is driven by motor 150, as shown in FIG. 3.

The size and shape of the transport cavities are selected to achieve the desired pellet flow to the discharge station. Considerations which influence the selection include number of transport cavities, size and speed of rotor, size of receiving and discharge stations, size and speed of helical worm screw, and transport gas pressure and velocity. Other design factors can also influence the practical design selection of the transport cavities.

The transport cavities 64 are shown here to have a generally rectangular opening at circumferential surface 66 and a generally rectangular cross-section when viewed along the axis of rotation of the rotor 62. When rotor 62 is rotated to a position where one of transport cavities 64 is in radial alignment with receiving station 42, pellets are mechanically fed into transport cavity 64 by the rotation of the helical worm screw 132. The rotation of rotor 62 transports the pellets radially to a position which is radially aligned with discharge station 68. Discharge station 68 communicates directly with channel 70, which is connected to a source of pressurized transport gas 36 through inlet fitting 72. The flow of pressurized transport gas through channel 70 is continuous during operation of the apparatus and is not interrupted by the rotation of rotor 62. Air is preferably used as the pressurized transport gas. The radial transportation of the pellets creates a centrifugal force which acts on the pellets. The orientation of discharge station 68 and transport cavities 64 allows this force to assist the discharge of pellets from the transport cavities 64. The pellets are discharged into discharge station 68, and move into channel 70. The flow of the pressurized transport gas through channel 70 moves the pellets through hose 56 to discharge nozzle 58, where they are discharged from the system. The nozzle is manipulated by an operator to project the pellets against an object to be cleaned.

Discharge station 68 is shown as being formed of a tubular section 74 extending from a flange section 76. A section of the wall 78 of tubular section 74 extends into channel 70 in the path of the pressurized transport gas. The section of wall 78 forms an arc of approximately 180° about the axis of tubular section 74. The section of wall 78 diverts the flow of pressurized transport gas around the partial cavity 80 which is formed at the end of discharge station 68. This diversion of the transport gas allows the pellets to travel nearly the length of tubular section 74 into channel 70 without being directly impinged upon by the transport gas. This diversion of transport gas facilitates the disbursement of the pellets into the flow path of the pressurized transport gas.

One or more openings 82 are located in the section of wall 78 such that some pressurized transport gas may flow through the openings 82 and directly into the partial cavity 80. The flow through opening 82 provides some motivating force, in addition to the natural dispersion of the pellets, for moving the pellets from the partial cavity 80 into the mainstream flow of the pressurized transport gas .

To assist the discharge of pellets from discharge station 68, a nozzle 84 is located in discharge station 68. Nozzle 84 is connected to a source of the high pressure transport gas and directs pressurized gas into transport cavity 64. The flow of the pressurized gas into transport cavity 64 assists in the expulsion of pellets from transport cavity 64. As contemplated, high pressure gas is supplied through an opening 86 in housing 48 which communicates with annular groove 88 located on the outside of tubular section 74. Nozzle 84 communicates directly with opening 88 and is thereby supplied the source of pressurized transport gas. Sealing rings 90 and 92 are located in O-ring grooves 4 and 96 on the outside of tubular section 74. Sealing rings 90 and 92 seal against bore 98 which is located in housing 48.

As mentioned above, it is important to maintain a slight pressure within the hopper and feeder apparatus of the subject invention to prevent the possible influx of moisture into the system. This pressure, however, is preferably a relatively low pressure. Because it is preferred that air under high pressure be used to convey the radially transported pellets from the discharge station to the discharge nozzle (e.g. pressures of up to approximately 300 psig), it is imperative that the high pressures present at discharge station 68 be isolated from the much lower pressures present at receiving station 42. To ensure the isolation of such pressure differentials within pellet feeder means 40, seal 100 is located between receiving station 42 and rotor 46, and seal 102 is located between rotor 46 and discharge station 68. These seals are preferably made of materials which can maintain their flexibility and seal integrity at the relatively low temperatures contemplated herein (e.g. silicone rubber as available from various sources, impregnated with Teflon or other dry lubricants). Seal 100 is of a complementary shape to mate with rotor 46 against a portion of the circumferential surface 66. Receiving station 42, as shown, is made of a tubular section 104 extending from a flange section 106. Seal 100 has an opening 108 which is aligned with receiving station 42. The face 110 of flange section 106 is urged against one side of seal 100 by a plurality of springs 112, which are in contact with flange section 106. The force exerted by springs 112 can be varied through adjusting the compressed height of springs 112 by rotating adjusting nuts 114. This allows the sealing force which urges seal 100 against circumferential surface 66 to be adjusted to maintain a proper seal.

In a similar manner, seal 102 is formed complementary to circumferential surface 56 of rotor 46. Flange face 116 of flange section 76 contacts seal 102. Springs 118 urge flange section 76 against seal 102 thereby creating a sealing force between seal 102 and circumferential face 66 of rotor 62. This force is controlled by adjusting the compressed height of springs 118 which are supported by rotary cams 120 and 122. By rotating cams 120 and 122 the compressed height of springs 18 is varied, thereby changing the sealing force. This allows adjustment of the sealing force as necessary.

The sealing capabilities of seals 100, 102 may be increased by the inclusion of circumferential ridges 160, 162 which are located on circumferential surface 66. After a breaking in period, these ridges 160, 162 form complimentary depression in seals 100, 102. The intermeshing of ridge 160, 162 with seals 100, 102 in this manner increases the ability of seals 100, 102 to seal circumferential surface 66.

As a result of the exposure to the high pressure transport gas, transport cavity 64, as it rotates out of communication with discharge station 68 after having discharged the pellets, is under pressure. A vent 124 is provided in the housing 48 which communicates directly with transport cavity 64 after it has rotated out of contact with seal 102. Vent 124 is located as close to the discharge seal 102 as possible, in the direction of rotation of rotor 62, following the discharge of the pellets.. A second vent 126 is located in housing 48 radially spaced about rotor cavity 46 from vent 124. Additional venting of transport cavity 64 occurs when transport cavity 64 is in communication with vent 126.

Vents 124 and 126 also assist in exiting pellets which remain in transport cavity 64 after passing discharge station 68. Pellets may tend to remain in transport cavity 64 during start up of the system until the unit has cooled down. Pellets may also tend to remain in transport cavity 64 during the initial break in period of the unit, until seals 100, 102 have seated. Vents 124 and 126 are large enough for pellets to pass through them, and generally the same shape as transport cavity 64, although not necessarily the same size.

A low pressure $CO_2$ supply port 128 is located in housing 48 radially spaced from vent 126, communicating with rotor cavity 46. Supply port 128 directly communicates with transport cavity 64 at a position just prior to transport cavity 64 rotating into contact with seal 100. Supply port 128 directs low pressure $CO_2$ gas into transport cavity 64 thereby minimizing the amount of moisture laden transport gas remaining in transport cavity 64. Supply port 128 also slightly pressurizes rotor cavity 46. This pressure creates a positive flow of $CO_2$ gas through vents 124 and 126, thereby preventing ambient gases from entering rotor cavity 46.

Seals 100 and 102 are shown having chambers 132, 134 oriented toward rotor 62. The chambers 132, 134 have the effect of increasing the exposure time of the transport cavity 64 to the receiving station 42 or the discharge station 68, thereby allowing more time for the filling of the transport cavity 64 with pellets, as the rotor 62 rotates at a given speed.

The improved sealing capability of the seals 100, 102, is more effective at isolating the pressurized transport gas from the receiving station 42 and rotor cavity 46 than designs found in the prior art. This improvement allows the use of a pressurized transport gas which has a higher moisture content, or dew point temperature than functionally permissible by the prior art. The improved design will allow the use of transport gas with a dew point temperature of up to 50° F.

Figure 4:
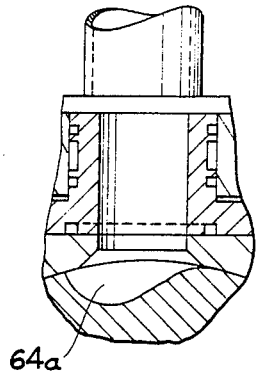
FIG. 4 is a cross-sectional view of an alternative cavity design.

FIG. 4 shows an alternative embodiment of transport cavity **64*a*. The shape shown is aerodynamically selected to facilitate the flow into transport cavity 64*a* of pressurized gas from nozzle 84*a*, creating an aerodynamic flow within transport cavity 64*a* which enhances the expulsion of the pellets from transport cavity 64*a***.

Figure 5:
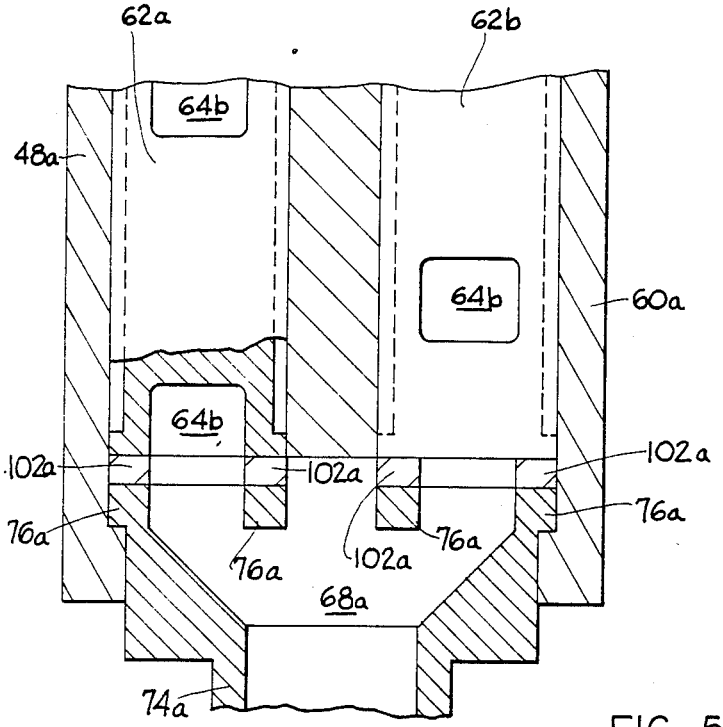
FIG. 5 is a side view in partial section of a dual rotor embodiment.

In a second embodiment, FIG. 5 shows the use of multiple rotors **62*a*, 62*b* disposed within the same rotor cavity 46*a*. The rotors 62*a*, 62*b* are mounted side by side on the same shaft (not shown) and rotate in synchronization. Transport cavities 64*b* are located on each rotor 62*a*, 62*b* such that neither cavity is directly radially aligned with the receiving station (not shown) or discharge station 68*a* at the same time. Transport cavities 64*b* are staggered such that, as transport rotors 62*a* and 62*b* rotate cavities 64*b* past the receiving station, the total cross sectional area of the opening of transport cavities 64*b* exposed to the receiving station remains constant as one transport cavity rotates out of radial alignment with the receiving station and the following transport cavity located on the adjacent rotor rotates into radial alignment with the receiving station. Thus, the constant rotational speed of rotor 62*a* and 62*b* allows pellets to flow through the receiving station and into transport cavity 64*b* without creating backup surges in the flow of the pellets into the receiving station. This staggering of the transport cavities 64*b* reduces the pulsating effect found in earlier systems. As shown, both rotors 62*a*, 62*b* would discharge into the same discharge station 68*a* and the pellets flow from the same discharge nozzle 58**. Such a system can easily be adapted to have two separate discharge stations, each adjacent separate high pressure transport gas streams, thereby allowing two, or even more, discharge streams of pellets. The system could also be adapted to have two receiving stations, each fed by its own helical worm screw.

Figure 6:
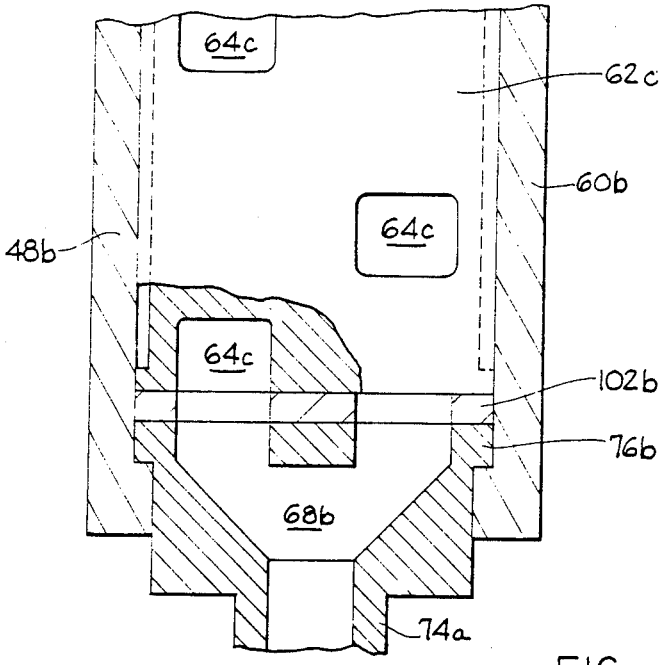
FIG. 6 a side view in partial section of a single rotor, twin cavity row embodiment.

FIG. 6 shows the use of a single rotor **62*b* having two rows of transport cavities 64*c*. The transport cavities 64*c* are oriented in a staggered relationship as described above for the multiple rotor embodiment and discharge into the same discharge station 68*b*. The inclusion of two rows on a single rotor 62*c* allows the use of a single seal (not shown) at the receiving station (not shown) and the use of a single seal 102*b* at the discharge station 68*b*. This staggering of the transport cavities 64*c*** also minimizes the pulsating effect found in the prior art.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

What is claimed:

1. An improved particle blast cleaning apparatus featuring sublimable pellets as the particulate matter, said apparatus comprising:

(a) a source of sublimable pellets;

(b) a housing defining an internal cavity, having spaced pellet receiving and discharge stations;

(c) means for radially transporting said pellets, said radial transport means being disposed within said internal cavity, said radial transport means having at least one pellet transport cavity disposed in the circumferential surface of said radial transport means which is alternately radially alignable with said receiving station and with said discharge station;

(d) mechanical flow means for mechanically assisting the flow of said pellets to said transport cavity at said receiving station, said mechanical flow means including:

(i) a shank, (ii) means for rotating said shank, (iii) at least one agitating member mounted to said shank, and (iv) at least on helical surface mounted to said shaft;

(e) a discharge nozzle; and (f) means for supplying a pressurized transport gas adjacent said discharge station for conveying said pellets from said discharge station to said discharge nozzle.

2. The particle blast cleaning apparatus of claim 1 wherein said mechanical flow means is at least partially disposed in said receiving station.

3. An improved particle blast cleaning apparatus featuring sublimable pellets as the particulate matter, said apparatus comprising:

(a) a source of sublimable pellets;

(b) a housing defining an internal cavity having space pellet receiving and discharge stations;

(c) a radial transport rotor disposed within said internal cavity having at least one pellet transport cavity disposed in the circumferential surface of said radial transport rotor which is alternately alignable with said receiving station and said discharge station;

(d) means for rotating said radial transport rotor;

(e) means for providing flow of said pellets to said transport cavity at said receiving station;

(f) a discharge nozzle;

(g) means for supplying a pressurized transport gas adjacent said discharge station for conveying said pellets from said discharge station to said discharge nozzle; and (h) first means for sealing disposed adjacent said circumferential surface and adjacent said receiving station, and second means for sealing disposed adjacent said circumferential surface and adjacent said discharge station.

4. The particle blast cleaning apparatus of claim 3 further comprising means for controlling pressure to isolate said receiving station from the pressurized environment at said discharge station.

5. The particle blast cleaning apparatus of claim 4 wherein said pressure controlling means comprises at least one pressure relief port located between said discharge station and said receiving station in communication with said internal cavity and with the ambient environment.

6. The particle blast cleaning apparatus of claim 3 further comprising at least one circumferential ridge disposed on said circumferential surface, said first and second sealing means intermeshing with said circumferential ridge.

7. The particle blast cleaning apparatus of claim 3 wherein at least one of said sealing means is a variably biased seal whose sealing pressure can be varied.

8. The particle blast cleaning apparatus for claim 7 wherein the variable bias of at least one of said seals is varied through rotation of at least one cam which compresses at least one resilient element, said resilient element urging said seal respectively into sealing engagement with said rotor.

9. The particle blast cleaning apparatus of claim 5 wherein said pressure relief port is located such that it radially aligns directly with said transport cavity as said transport cavity successively travels past said relief port.

10. The particle blast cleaning apparatus of claim 3 wherein said pressurized transport gas has a pressure of up to approximately 300 psig.

11. The particle blast cleaning apparatus of claim 3 wherein said pressurized transport gas has a dew point temperature of up to approximately 50° F.

12. The particle blast cleaning apparatus of claim 3 further comprising means for directing pressurized gas toward said transport cavity while said transport cavity is aligned with said discharge station.

13. The particle blast cleaning apparatus of claim 12 wherein said directing means is a nozzle.

14. The particle blast cleaning apparatus of claim 12 wherein said transPort cavity is aerodynamically shaped, complementary with the flow of pressurized gas from said directing means to effect the discharge of said pellets from said transport cavity.

15. The particle blast cleaning apparatus of claim 3 wherein said discharge station includes a means for diverting the flow of said pressurized transport gas such that said pellets may drop freely through said discharge station and be conveyed by said pressurized transport gas.

16. The particle blast cleaning apparatus of claim 15 wherein said diverting means partially diverts said pressurized transport gas.

17. The particle blast cleaning apparatus of claim 15 wherein said diverting means is a tube extending into the flow path of said pressurized transport gas.

18. The particle blast cleaning apparatus of claim 15 wherein said diverting means is a wall extending into the flow path of said pressurized transport gas.

19. The particle blast cleaning aPparatus of claim 18 wherein said wall forms an arc of approximately 180°, said arc having a midline and an axis, said midline being located on the outer surface of said wall, said midline and said axis being aligned with said discharge station, said axis being downstream of said midline in relation to the flow of said pressurized transport gas.

20. The particle blast cleaning apparatus of claim 18 wherein said wall has at least one openings disposed therein, thereby allowing a partial flow of said pressurized transport gas to pass through said openings.

21. The particle blast cleaning apparatus of claim 3 further comprising means for supplying pressurized gas to said internal cavity.

22. The particle blast cleaning apparatus of claim 21 wherein said supply means comprises at least one port in said housing, said at least one port being connected to a source of pressurized gas.

23. The particle blast cleaning apparatus of claim 22 wherein at least one of said ports are aligned to direct said gas directly into said transport cavity as said transport cavity successively travels past said port.

24. The particle blast cleaning apparatus of claim 3 further comprising means for diverting pellets from entering said housing for disposal when desired, said diverting means including a diverting valve having open and closed positions, and means for providing an airtight seal about the periphery of said diverting valve in said closed position.

25. The particle blast cleaning apparatus of claim 3, comprising at least two radial transport rotors disposed within said internal cavity, each said rotor having at least one pellet transport cavity disposed in each circumferential surface thereof which is alternately radially alignable with said receiving station and said discharge station, said radial transport rotors being rotatably synchronized with respect to each other.

26. The particle blast cleaning apparatus of claim 25 wherein said pellet transport cavity of each said radial transport rotor is staggered with respect to said pellet transport cavity of the other radial transport rotor.

27. The particle blast cleaning apparatus of claim 25 further comprising at least one means for directing pressurized transport gas toward each said transport cavity, said directing means being disposed on each said radial transport rotor when each said transport cavity is aligned with said discharge station.

28. The particle blast cleaning apparatus of claim 27 wherein said directing means comprises at least one nozzle.

29. The particle blast cleaning apparatus of claim 25 further comprising at least two discharge stations communicating with said internal cavity, each said discharge station being aligned with one of said radial transport rotors.

30. The particle blast cleaning apparatus of claim 29 further comprising:

(a) at least two discharge nozzles; and (b) at least one means for supplying pressurized transport gas adjacent one of said discharge stations for conveying said pellets from said discharge station to one of said discharge nozzles.

31. The particle blast cleaning apparatus of claim 3 wherein a plurality of pellet transport cavities are disposed in said circumferential surface of said radial transport rotor, forming at least two rows of transport cavities about said circumferential surface.

32. The particle blast cleaning apparatus of claim 31 wherein said transport cavities of at least two of said rows are in a staggered relationship with respect to each other.

33. The particle blast cleaning apparatus of claim 32 further comprising two or more discharge stations communicating with said internal cavity, each said discharge station being aligned with one of said rows of transport cavities disposed on said radial transPort rotor.

34. The particle blast cleaning apparatus of claim 33 further comprising:

(a) at least two discharge nozzles; and (b) at least one means for supplying a pressurized transport gas adjacent each said discharge station for conveying said particles from said discharge station to one of said discharge nozzles.

35. The particle blast cleaning apparatus of claim 3 wherein said flow means comprises mechanical flow means for mechanically assisting the flow of said pellets to said transport cavity at said receiving station.

36. An improved particle blast cleaning apparatus featuring sublimable pellets as the particulate matter, said apparatus comprising:

(a) a source of sublimable pellets;

(b) a housing defining an internal cavity having spaced pellet receiving and discharge stations;

(c) a radial transport rotor disposed within said internal cavity having at least one pellet transport cavity disposed in the circumferential surface of said radial transport rotor which is alternately alignable with said receiving station and said discharge station;

(d) means for rotating said radial transport rotor;

(e) means for providing gravity flow of said pellets to said transport cavity at said receiving station;

(f) a discharge nozzle;

(g) means for supplying a pressurized transport gas adjacent said discharge station for conveying said pellets from said discharge station to said discharge nozzle; and (h) first means for sealing disposed adjacent said circumferential surface and adjacent said receiving station, and second means for sealing disposed adjacent said circumferential surface and adjacent said discharge station.

37. The particle blast cleaning apparatus of claim 36 further comPrising at least one circumferential ridge disposed on said circumferential surface, said first and second sealing means intermeshing with said circumferential ridge.

38. The particle blast cleaning apparatus of claim 36 wherein said first sealing means is provided with an opening complimentary to said receiving station whereby said receiving station communicates with said internal cavity, and said second means is provided with an opening complimentary with said discharge station whereby said discharge station communicates with said internal cavity.

39. The particle blast cleaning apparatus of claim 38 further comprising at least one pressure relief port located between said discharge station and said receiving station which communicates with said internal cavity.

40. An improved particle blast cleaning apparatus featuring sublimable pellets as the particulate matter, said apparatus comprising:

(a) a source of sublimable pellets;

(b) a housing defining an internal cavity, having spaced pellet receiving and discharge stations;

(c) means for radially transporting said pellets disposed within said internal cavity, said radial transporting means having at least one pellet transport cavity disposed in the circumferential surface of said radial transport means which is alternately alignable with said receiving station and with said discharge station;

(d) means for providing flow of said pellets to said transport cavity at said receiving station;

(e) a discharge nozzle;

(f) means for supplying a pressurized transport gas adjacent said discharge station for conveying said pellets from said discharge station to said discharge nozzle; and (g) means for diverting the flow of said pressurized transport gas such that said pellets may drop through said discharge station and be conveyed by said pressurized transport gas, said diverting means including a wall which extends into the flow path of said pressurized transport gas, said wall forming an arc of approximately 180°, said arc having a midline and an axis, said midline being located on the outer surface of said wall, said midline and said axis being aligned with said discharge station, said axis being downstream of said midline in relation to the flow of said pressurized transport gas.

41. An improved particle blast cleaning apparatus featuring sublimable pellets as the particulate matter, said apparatus comprising:

(a) a source of sublimable pellets;

(b) a housing defining an internal cavity, having spaced pellet receiving and discharge stations;

(c) means for radially transporting said pellets disposed within said internal cavity, said radial transporting means having at least one pellet transport cavity disposed in the circumferential surface of said radial transport means which is alternately alignable with said receiving station and with said discharge station;

(d) means for providing flow of said pellets to said transport cavity at said receiving station;

(e) a discharge nozzle;

(f) means for supplying a pressurized transport gas adjacent said discharge station for conveying said pellets from said discharge station to said discharge nozzle; and (g) means for diverting the flow of said pressurized transport gas such that said pellets may drop through said discharge station and be conveyed by said pressurized transport gas, said diverting means including a wall which extends into the flow path of said pressurized transport gas, said wall having at least one opening disposed therein, thereby allowing a partial flow of said pressurized transport gas to pass through said at least one opening.

42. An improved particle blast cleaning apparatus featuring sublimable pellets as the particulate matter, said apparatus comprising:

(a) a source of sublimable pellets;

(b) a housing defining an internal cavity, having spaced pellet receiving and discharge stations;

(c) means for radially transporting said pellets disposed within said internal cavity, said radial transporting means having at least one pellet transport cavity disposed in the circumferential surface of said radial transport means which is alternately alignable with said receiving station and with said discharge station;

(d) means for providing flow of said pellets to said transport cavity at said receiving station;

(e) a discharge nozzle;

(f) means for supplying a pressurized transport gas adjacent said discharge station for conveying said pellets from said discharge station to said discharge nozzle; and (g) means for supplying pressurized gas to said internal cavity.

43. The particle blast cleaning apparatus of claim 42, wherein said supply means comprises at least one port in said housing, said at least one port being connected to a source of pressurized gas.

44. The particle blast cleaning apparatus of claim 43, wherein at least one of said port is aligned to direct said gas directly into said at least one transport cavity as said at least one transport cavity successively travels past said at least one port.

* * * * *

UNITED STATES PATENT AND TRADEMARK OFFICE

CERTIFICATE OF CORRECTION

PATENT NO. : 4,947,592

DATED : August 14, 1990

INVENTOR(S) : David E. Moore, Daniel L. Lloyd, Newell D. Crane

It is certified that error appears in the above-identified patent and that said Letters Patent is hereby corrected as shown below:

In claim 1, column 11, line 7, delete "on", and insert therefor --one--.

In claim 3, column 11, line 20, delete "space", and insert therefor --spaced--.

In claim 8, column 11, line 59, before "claim" delete "for", and insert therefor --of--.

In claim 14, column 12, line 16, delete "transPort", and insert therefor --transport--.

In claim 19, column 12, line 35, delete "aPparatus", and insert therefor --apparatus--.

In claim 20, column 12, line 43, delete "openings", and insert therefor --opening--.

In claim 20, column 12, line 45, delete "openings", and insert therefor --at least one opening--.

In claim 33, column 13, line 42, delete "transPort", and insert therefor --transport--.

In claim 37, column 14, line 14, delete "comPrising", and insert therefor --comprising--.

In claim 40, column 14, line 36, after "pellets" insert --, said radial transport means being--.

In claim 41, column 15, line 1, after "pellets" insert --, said radial transport means being--.

UNITED STATES PATENT AND TRADEMARK OFFICE

CERTIFICATE OF CORRECTION

PATENT NO. : 4,947,592

DATED : August 14, 1990

INVENTOR(S) : David E. Moore, Daniel L. Lloyd, Newell D. Crane

It is certified that error appears in the above-identified patent and that said Letters Patent is hereby corrected as shown below:

In claim 42, column 16, line 3, after "pellets" insert --said radial transport means being--.

Signed and Sealed this

Twenty-first Day of April, 1992

*Attest:*

HARRY F. MANBECK, JR.

*Attesting Officer*

*Commissioner of Patents and Trademarks*